US005331683A

United States Patent [19]

Stone et al.

[11] Patent Number: 5,331,683

[45] Date of Patent: Jul. 26, 1994

[54] PROTECTIVE BODY ARMOR GARMENT SHELL

[75] Inventors: Richard Stone, Holbrook; David R. Hand, Kings Park, both of N.Y.

[73] Assignee: Point Blank Body Armor, Inc., Amityville, N.Y.

[21] Appl. No.: 795,187

[22] Filed: Nov. 13, 1991

Related U.S. Application Data

[63] Continuation-in-part of Ser. No. 601,267, Oct. 22, 1990, Pat. No. 5,073,985.

[51] Int. Cl.[5] ..... F41H 1/02

[52] U.S. Cl. ..... 2/2.5; 2/92; 2/102

[58] Field of Search ..... 2/2, 2.5, 48, 102, 104, 2/111, DIG. 7, 94, 92, 113, 103, DIG. 6; 89/36.05

[56] References Cited

U.S. PATENT DOCUMENTS

| | | | |
|---|---|---|---|
| 866,342 | 9/1907 | Demacakos | 2/95 |
| 965,487 | 7/1910 | Scott | 2/113 |
| 1,112,805 | 10/1914 | Kaufman | 2/113 |
| 1,163,094 | 12/1915 | Kurek | 2/2.5 |
| 1,400,881 | 12/1921 | King | 2/92 |
| 1,739,112 | 12/1929 | Wisbrod | 2/2.5 |
| 1,763,892 | 6/1930 | Knoernschild | 2/93 |
| 2,743,446 | 5/1956 | Persico et al. | 2/2.5 |
| 2,948,898 | 8/1960 | Allen | 2/94 |
| 2,954,563 | 10/1960 | DeGrazia | 2/2.5 |
| 3,011,172 | 12/1961 | Tames | 2/DIG. 7 |
| 3,557,384 | 1/1971 | Barron et al. | 2/2.5 |
| 3,803,640 | 4/1974 | Ericson | 2/DIG. 7 |
| 4,266,297 | 5/1981 | Atkins | 2/2.5 |
| 4,466,135 | 8/1984 | Coppage, Jr. | 2/2.5 |
| 4,485,491 | 12/1984 | Rasmussen | 2/2.5 |
| 4,535,478 | 8/1985 | Zufle | 2/2.5 |
| 4,578,821 | 4/1986 | Zufle | 2/2.5 |
| 4,601,067 | 7/1986 | Buonassissi | 2/94 |
| 4,602,385 | 7/1986 | Warren | 2/2 |
| 4,769,855 | 9/1988 | Tsai | 2/DIG. 6 |
| 5,060,314 | 10/1991 | Lewis | 2/2.5 |
| 5,157,792 | 10/1992 | Allen et al. | 2/92 |

*Primary Examiner*—Clifford D. Crowder
*Assistant Examiner*—Amy B. Vanatta
*Attorney, Agent, or Firm*—McAulay Fisher Nissen Goldberg & Kiel

[57] ABSTRACT

A protective body armor garment shell is disclosed which has a front panel and a back panel made of a lightweight material and having features simulating a uniform shirt such that the garment shell can be worn over or in place of a standard uniform shirt and maintain a professional appearance while concealing the fact that body armor is being worn. The back panel is attached to the body utilizing a belt which firmly retains the garment to the body even when the front panel is loosely draped across the chest. The drapable feature allows a person wearing the garment to loosen the front panel to provide ventilation while maintaining the garment on the body, to maximize comfort.

18 Claims, 4 Drawing Sheets

PROTECTIVE BODY ARMOR GARMENT SHELL

CROSS REFERENCE TO RELATED APPLICATION

This application is a continuation-in-part of application Ser. No. 601,267, filed Oct. 22, 1990, now U.S. Pat. No. 5,073,985.

TECHNICAL FIELD

This invention relates to protective body armor and more particularly to a garment shell for concealing body armor by simulating a uniform garment.

BACKGROUND

Protective body armor panels, such as those disclosed in U.S. Pat. No. 4,660,223 and U.S. patent application Ser. No. 421,077 filed Oct. 13, 1989 titled "Improved Body Armor Insert", both commonly assigned herewith, are used to prevent injury from fire arms. Such panels either have various shoulder straps or belt portions to fasten the body armor to the body or are disposed in a vest like garment shell which includes the straps or belts.

Typically, there are two types of protective body armor worn by police officers. One type is for entering known hazardous situations where the armor is worn over the officer's uniform together with other protective gear. The second type of body armor is worn doing routine duties such as patrolling, with the armor panels providing protection in unexpectedly hazardous situations. The second type of body armor is worn beneath the officer's uniform shirt to conceal it from individuals which the officer may confront. This concealment is an advantage in many situations. However, once the body armor is in place, it cannot be taken off or loosened until the officer's shift is completed.

The concealed types of body armor panels can become particularly uncomfortable in warm weather as the panels prevent ventilation of the body and restrict moisture removal. Since the body armor may not be worn in hot weather to avoid discomfort, this may place an officer at risk. Consequently, a need has arisen for concealable body armor which is convenient to wear, has a professional appearance and allows ventilation during performance of routine duties.

SUMMARY OF THE INVENTION

It is an object of the present invention to provide a body armor garment shell adapted for supporting body armor panels.

It is a further object to provide a garment shell which simulates an officers uniform garment, such as an officer's shirt, such that the garment can be worn over rather than under the officer's shirt, without losing the advantage of concealment.

It is a further object to provide a garment shell which has a drapable front panel to ease ventilation and comfort.

It is another object to provide a garment shell with means to assure secure fastening of a front or back panel when subject to ballistic impact.

These and other objects to the present invention are achieved by providing a body armor garment shell having a front portion and a back portion and means for interconnecting said portions over the shoulders, and, belt means extending from the back portion and being engagable beneath the front panel, to allow draping the front portion over the chest. Preferably, the front portion simulates a uniform garment. The garment shell also has releasable means for fixing the front portion to the back portion. The belt means, extending from the back portion, releasably secure the garment shell to the body to prevent garment shifting when the front portion is released from the back portion.

In another embodiment the garment shell is a facade disposed over a carrier garment which incorporates the protective body armor panels. The back of the carrier and facade are secured by belt means to the waist. However, belt means extend from the portion of the carrier to secure the carrier in place. The front of the shell may then be attached to the side panels to complete the assembly. Thus, the front of the garment shell or the front of the carrier or both can be released depending on the degree of comfort sought relative to the degree of safety required.

Additionally, means are provided to maintain secure fastening of the panels together when subject to ballistic impact.

The garment shell is preferably made of a light weight cotton, polyester blend or any such material as used in a uniform shirt to simulate a uniform shirt. Thus, the shell can be worn over a standard uniform shirt or similar garment and simulate an officer's standard uniform. This provides the officer with a professional appearance and allows loosening of the front portion in non-hazardous conditions to improve comfort. The drapable feature of the front portion allows keeping the protective armor on and in place during the performance of routine duties, providing for rapid securement should the need arise.

DETAILED DESCRIPTION OF THE PREFERRED EMBODIMENTS

Figure 1:
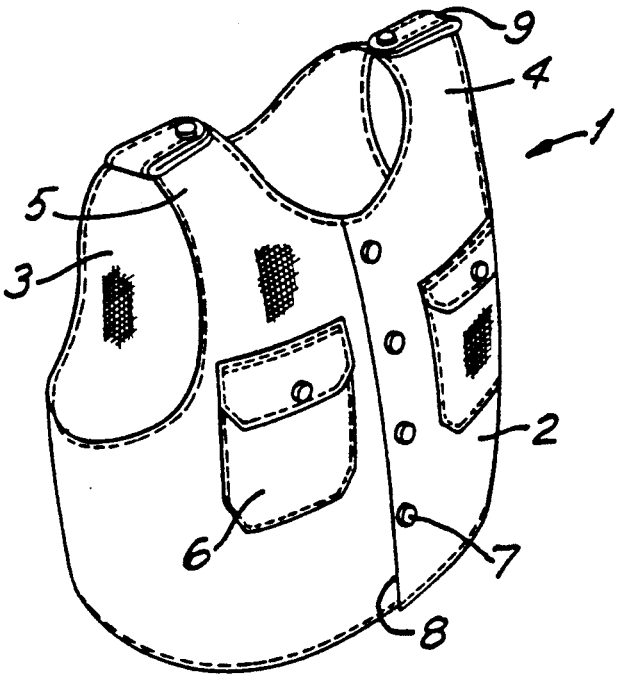
FIG. 1 is a perspective view of the inventive garment shell of the present invention.

Referring to FIG. 1, a protective body armor garment shell 1 is shown having a front portion 2 and a back portion 3 connected by shoulder straps 4 and 5. The garment shell includes pockets 6, buttons 7 adjacent a center seam 8 and epaulets 9 to simulate the appearance of a uniform shirt. Preferably, the garment shell is composed of a lightweight cotton, polyester or similar material essentially identical to that used to produce uniform style shirts. This allows the shell to match the texture and color as well as the appearance of the garment. However, the buttons 7 and seam 8 in this embodiment are merely a simulation and cannot be used to open the garment shell. The pockets may be real or simulated. Of course, additional simulated features, such as a shirt collar, sleeves, badge attaching grommets, etc., could also be added to the shell.

Figure 2:
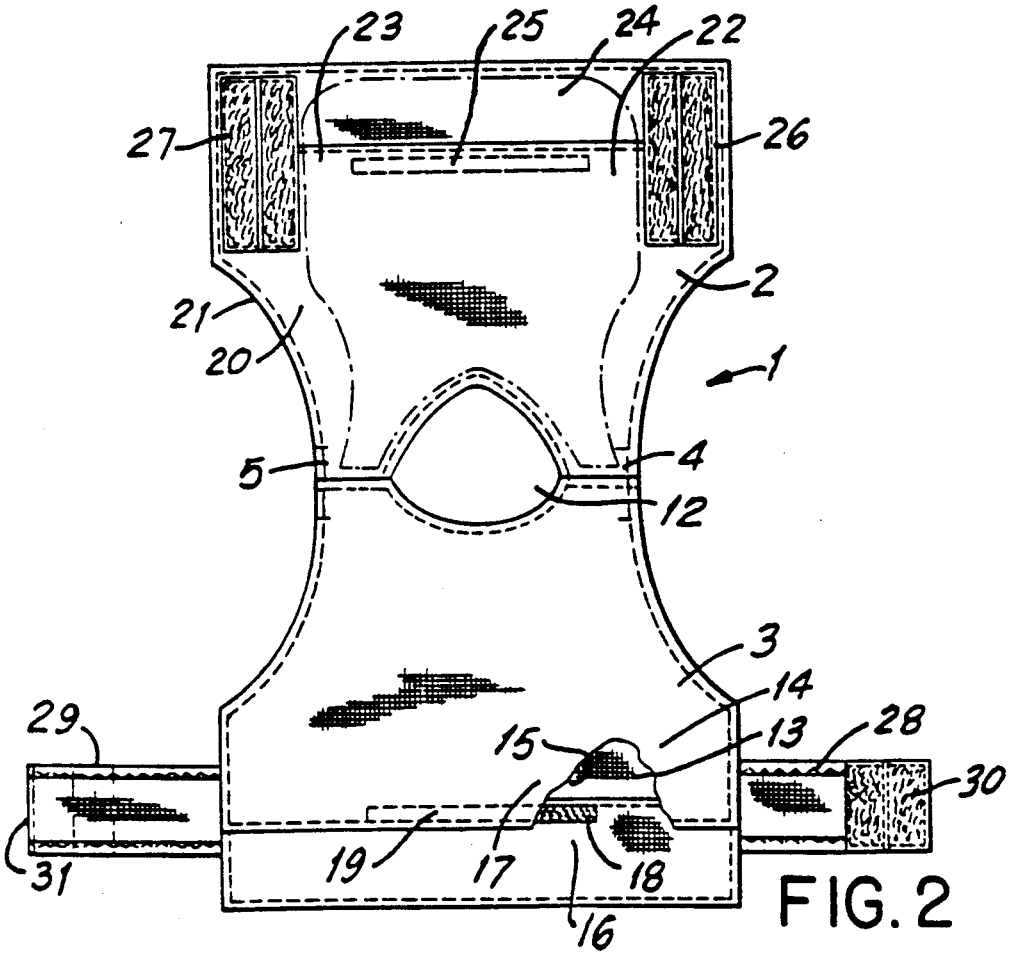
FIG. 2 is a view of the inner surfaces of the garment shell of FIG. 1, as provided prior to application to the body.

Referring to FIG. 2, the garment shell of FIG. 1 is shown in the open condition. The shoulder straps 4 and 5 connect the front and back portions 2 and 3, and form a head opening 12. The back portion 3 includes an inner layer 13 and an outer layer 14 forming a pocket 15 therebetween. A body armor panel (not shown) may be placed in the pocket 15. The inner layer has a lower section 16 partially overlaid by an upper section 17. An opening is provided between the over-laid sections. A pair of mating separable fasteners 18 and 19 are provided on opposite sides of the overlaid sections to maintain the sections in a closed condition. For illustrative purposes, the separable fasteners 18 and 19 are VELCRO TM or equivalent hook and pile fastener strips, which ease fastening and unfastening the opening. While VELCRO TM strips are shown, other separable fasteners could be used with the present invention, for example, snaps or zippers.

The front panel 2 is similar to the back panel 3, having a pair of fabric layers 20 and 21 between which a protective body armor panel 22 is disposed (shown in phantom). The inner fabric layer has similar overlaid sections 23 and 24, having a pair of mated fasteners 25 to maintain the sections in a closed condition. The inner layer also includes a pair of side fasteners 26 and 27 along opposing lower sides thereof. Preferably, these fasteners are hook and pile fastener strips.

The back panel 3 has a pair of straps 28 and 29 which are engaged to form a belt. Each strap has a fastener, 30 and 31 respectively, provided at the ends thereof. Each fastener is of sufficient length to allow adjustment to conform to the waist of the user.

Figure 3:
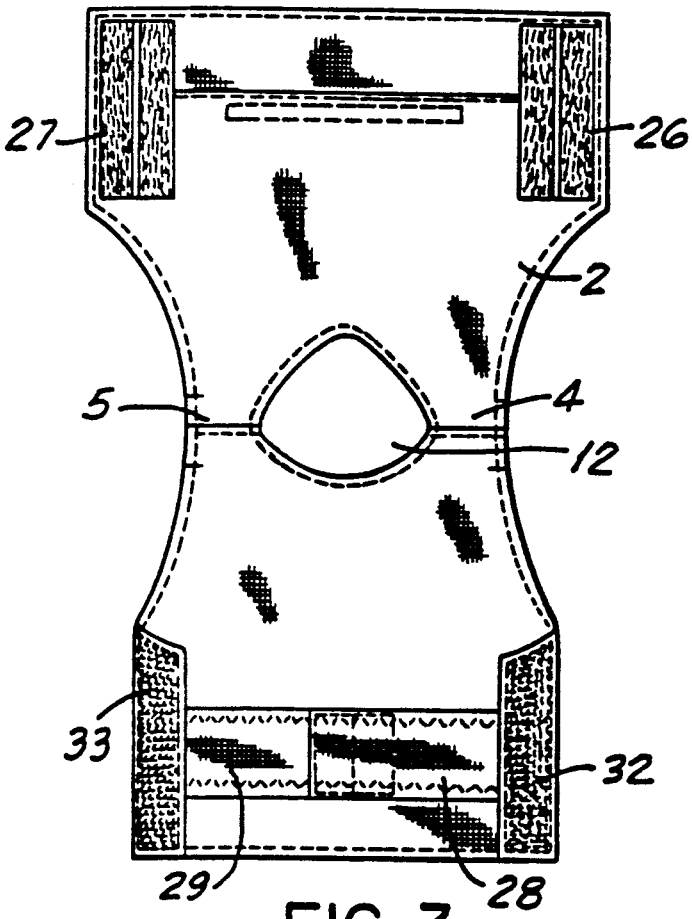
FIG. 3 is view showing the garment shell of FIG. 2 with the belt means engaged for holding the shell to the body.

Referring to FIG. 3, the straps 28 and 29 are shown in the engaged position, with the fasteners 30 and 31 in contact. When the straps 28 and 29 are engaged, a pair of side fasteners 32 and 33 are exposed which are matable to the side fasteners 26 and 27 from the front panel. The side fasteners 32 and 33 are provided on the outer layer of the back panel. Thus, to don the garment shell, the front and back portions would be draped over the body, with the front portion placed over the chest. The straps 28, 29 would be fitted snugly to the waist and the fasteners 26 and 27 would be mated with the fasteners 32 and 33. The back panel is thus attached to the body using a belt which firmly retains the garment to the body even when the front panel is loosely draped across the chest. Preferably, VELCRO TM strips are used as the fastening devices to allow rapid removal of the vest if necessary without fumbling with straps, buckles, clips or other attachment means.

Figure 4:
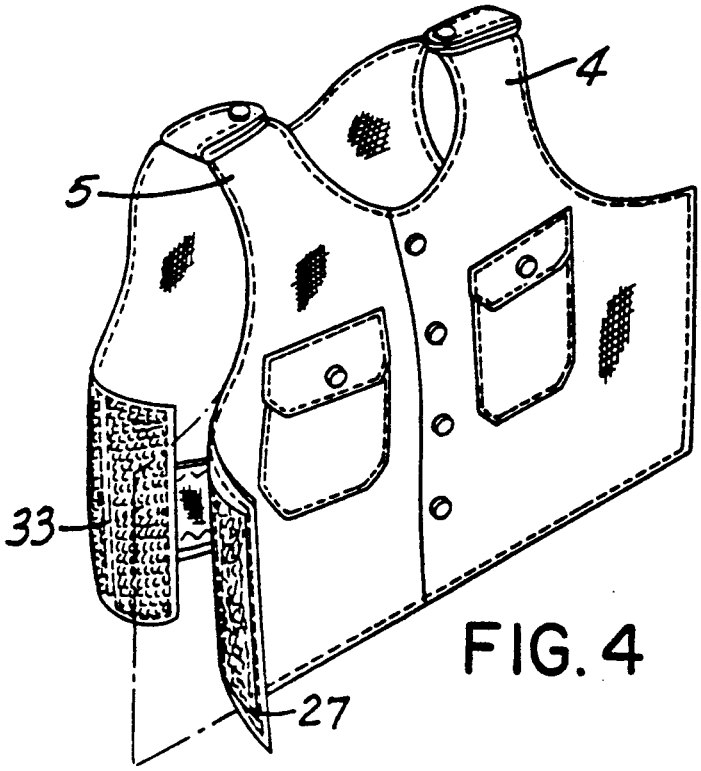
FIG. 4 is a perspective view showing the garment shell as it would be placed on the body, with the belt means engaged and the front panel being draped loosely for ventilation.

Referring to FIG. 4, the vest is shown as it would be utilized when ventilation is desired to increase comfort. The fasteners 26 and 27 would be disengaged from the fasteners 32 and 33, yet the belt would securely hold the garment shell to the person's body. Thus the front panel, being draped over the person's chest maintains the front panel body armor in a position to protect the chest. If necessary, the side fasteners would be engaged to provide a neat appearance. Since the garment simulates the appearance of a uniform shirt, the officer can maintain a professional appearance yet maximize protection and comfort. Also, if necessary the garment can be removed quite easily. If the officer is wearing a uniform shirt beneath this garment, he can operate free of the vest without having to disrobe. Similarly, the garment can be quickly applied over a shirt if necessary. This quick on and off feature overcomes a major inconvenience with previous body armor positioned beneath a uniform shirt and should increase the utilization of such garments.

Another feature of the invention is to maintain the garment shell front panel against the body upon ballistic impact. It was found during testing that side fasteners must be attached to the front panel in a particular way to avoid separation of the fasteners upon ballistic impact. Should separation occur, there is a potential vulnerability to additional impacts.

For example, a garment shell having a front panel with an outer fabric layer, and an inner fabric layer may use a pair of separable fasteners along opposing lower sides, for attachment to the sides of the back panels. The inner and outer layers are attached by stitching at the edges. The separable fasteners are attached to the inner layer along the outer edges. Such a garment shell was subject to ballistic impact and it was found that the impact may cause a force to be exerted on the outer layer which is transmitted to the outside edge seam. When this occurs, the force may be sufficient to pull the outer layer from the outside edge and cause the inner layer and separable fasteners to peel apart and separate, releasing the front panel from the body. Thus, the impact simulates the pulling force used to separate such fasteners.

Referring to Table I, a garment shell containing body armor panels was subjected to ballistic impact from a 0.357 magnum (158 grs.). The garment shell has only edge stitching and utilized VELCRO separable fasteners. Upon impact, one or both side closures separated. This occurred with both side impact and with impact at a 30° oblique angle. In tests 6, 7 and 8, done with a 0.44 magnum (240 grs.), both side closures separated.

TABLE I

| TEST | VELOCITY, FPS | HIT/PENETRATION | COMMENTS |
|---|---|---|---|
| 1 | 1414 | FAIR: YES<br>PENET: PARTIAL | SIDE CLOSURES PULLED APART FROM IMPACT |
| 2 | 1376 | FAIR: YES<br>PENET: PARTIAL | SIDE CLOSURE ALMOST PULLED APART |
| 3 | 1432 | FAIR: YES<br>PENET: PARTIAL | 30 DEGREE OBLIQ. SIDE CLOSURE PULLED APART |
| 4 | 1457 | FAIR: YES<br>PENET: PARTIAL | 30 DEGREE OBLIQ. SIDE CLOSURE PULLED APART |
| 5 | 1461 | FAIR: YES<br>PENET: PARTIAL | 30 DEGREE OBLIQ. SIDES PULLED APART |
| 6 | 1399 | FAIR: YES<br>PENET: PARTIAL | 30 DEGREE OBLIQ. SIDE CLOSURE SEPARATED |
| 7 | 1411 | FAIR: YES<br>PENET: PARTIAL | BOTH SIDE CLOSURES SEPARATED BY IMPACT |
| 8 | 1415 | FAIR: YES | BOTH SIDE |

TABLE I-continued

| TEST | VELOCITY, FPS | HIT/PENETRATION | COMMENTS |
|---|---|---|---|
| | | PENET: PARTIAL | CLOSURE SEPARATED BY IMPACT |

This was quite surprising as VELCRO separable fasteners had been used previously in body armor garments without the discovery of this problem. Once discovered several solutions were identified to prevent this separation.

Figure 5:
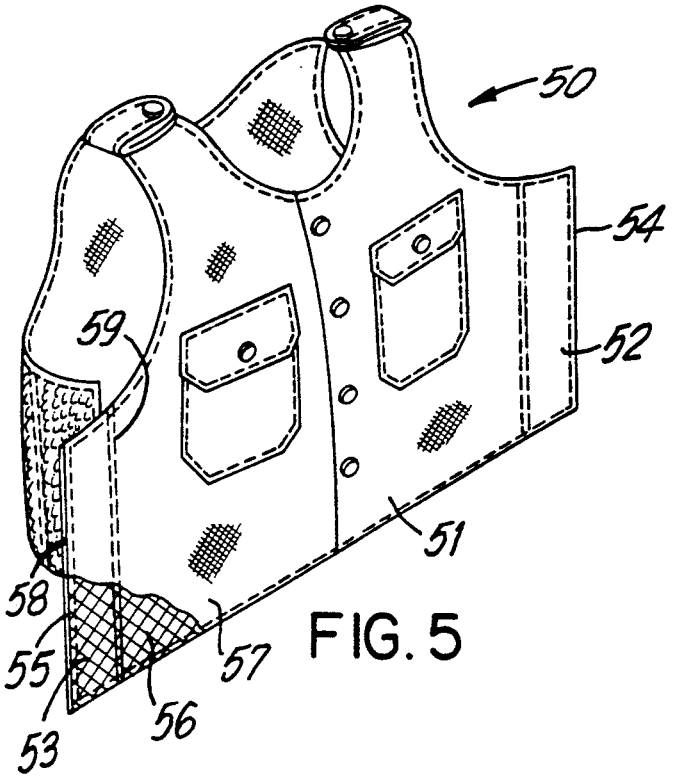
FIG. 5 is a perspective view showing the use of stitching to provide secure fastening.

Referring to FIG. 5, a garment shell 50 has a pair of side panels 52 and 53 and has a pair of separable fasteners 54 and 55 on an inner fabric layer 56 thereof. The front panel has an outer layer 57 which is stitched to the inner layer 56 along a common outer edge 58. However, a stitched seam 59 is added along an inner edge of the fastener 55 to secure the inner and outer layers to an inner edge of the fastener.

With this additional seam, any ballistic force will be transmitted to the seam 59 and will apply a shear force to the attached fasteners. Hook and pile separable fasteners made for example from VELCRO material are quite strong in shear and do not separate.

While providing secure fastening, the additional seam does not detract from the garment appearance and there is no loss of the concealment feature.

Figure 6:
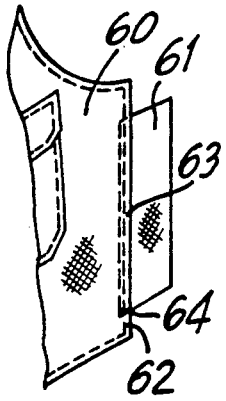
FIG. 6 is an alternative embodiment incorporating a separate fastening strip for use with the garment shell.
Figure 7A:
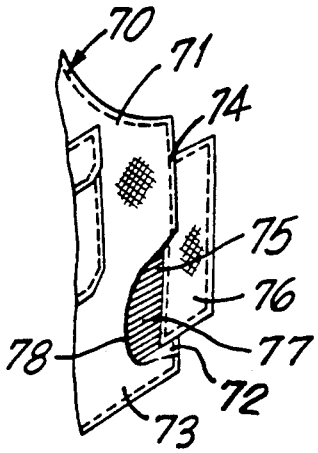
FIG. 7*a* and 7*b* show another embodiment using an elastic interconnecting strip and a concealing pleat.
Figure 7B:
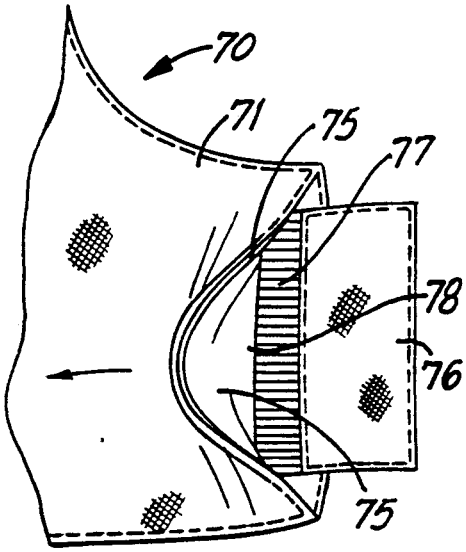

Referring to FIG. 6, an alternative embodiment is shown. A side panel 60 is shorter than the side panel 52 and a separate fabric covered fastener 61 is attached to an outer panel edge 62 by a seam 63. This allows producing the fasteners as separate assemblies with the outer edge seam 63 joining the inner and outer layers to an inner edge 64 of the fastener. The same features, secure fastening, concealment and conversion of ballistic forces to a shearing action are achieved.

Referring to FIG. *7a* and *7b*, another embodiment layer 72 is shown. A garment shell 70 has a side panel 71 with an inner layer 72 and an outer layer 73. The outer layer has a folded pleat 74 which forms a pocket 75. A separate fabric covered fastener is attached to an elastic strip 77 which is attached at its inner edge 78 to an inner portion of the pocket.

The pleat 74 serves to cover the elastic to maintain the concealment feature of the garment and provides some fabric which acts as slack to absorb some of the pulling force, thereby dampening the force pulling on the fastener. This is shown in FIG. *7b*.

The elastic strip performs a similar function by absorbing some of the shear force to reduce the possibility of failure in shear. While shown in combination, it should be understood that each of these modifications can be used individually. For example, the embodiment of FIG. 6 could additionally incorporate the elastic strip, the pleat, or both.

Referring to Table II, testing was conducted on a garment shell using a 0.44 magnum (240 gr.). Tests 1–19 used an inner edge stitch and a separate fastener assembly. Tests 20–22 used an elastic strip between the fastener strip and the front panel outer edge. All held securely, even when ballistic impacts were directed on the closure edge itself.

TABLE II

| TEST | VELOCITY, FPS | HIT/PENETRATION | COMMENTS | EMBODIMENT |
|---|---|---|---|---|
| 1 | 1422 | FAIR: YES<br>PENET: PARTIAL | SIDE CLOSURES HELD SECURE | SEPARATE SIDE TABS |
| 2 | 1435 | FAIR: YES<br>PENET: PARTIAL | SIDE CLOSURES HELD SECURE | SEPARATE SIDE TABS |
| 3 | 1447 | FAIR: YES<br>PENET: PARTIAL | CLOSURES HELD | SEPARATE SIDE TABS |
| 4 | 1462 | FAIR: YES<br>PENET: PARTIAL | CLOSURES HELD | SEPARATE SIDE TABS |
| 5 | 1457 | FAIR: YES<br>PENET: PARTIAL | CLOSURES HELD | SEPARATE SIDE TABS |
| 6 | 1390 | FAIR: NO<br>PENET: PARTIAL | 30 DEGREE OBLIQ. SIDE CLOSURES HELD SECURE | SEPARATE SIDE TABS |
| 7 | 1416 | FAIR: YES<br>PENET: PARTIAL | SIDE CLOSURES | SEPARATE SIDE TABS |
| 8 | 1440 | FAIR: YES<br>PENET: PARTIAL | 30 DEGREE OBLIQ. SIDE CLOSURES HELD SECURE | SEPARATE SIDE TABS |
| 9 | 1418 | FAIR: YES<br>PENET: PARTIAL | CENTER IMPACT, SIDE CLOSURES HELD SECURE | SEPARATE SIDE TABS |
| 10 | 1415 | FAIR: YES<br>PENET: PARTIAL | 30 DEGREE OBLIQ. SIDE CLOSURES HELD SECURE | SEPARATE SIDE TABS |
| 11 | 1414 | FAIR: YES<br>PENET: PARTIAL | 45 DEGREE OBLIQ. SIDE CLOSURES HELD SECURE | SEPARATE SIDE TABS |
| 12 | 1440 | FAIR: YES<br>PENET: PARTIAL | 45 DEGREE OBLIQ. SIDE CLOSURES HELD SECURE | SEPARATE SIDE TABS |
| 13 | 1412 | FAIR: YES<br>PENET: PARTIAL | 30 DEGREE OBLIQ. SIDE CLOSURES HELD SECURE | SEPARATE SIDE TABS |
| 14 | 1419 | FAIR: YES | CENTER IMPACT, | SEPARATE |

TABLE II-continued

| TEST | VELOCITY, FPS | HIT/PENETRATION | COMMENTS | EMBODIMENT |
|---|---|---|---|---|
| | | PENET: PARTIAL | SIDE CLOSURES HELD SECURE | SIDE TABS |
| 15 | 1412 | FAIR: YES PENET: PARTIAL | CENTER IMPACT, SIDE CLOSURES HELD SECURE | SEPARATE SIDE TABS |
| 16 | 1451 | FAIR: YES PENET: PARTIAL | 30 DEG. ½" FROM CLOSURE-CLOSURE HELD SECURE | SEPARATE SIDE TABS |
| 17 | 1406 | FAIR: YES PENET: PARTIAL | 30 DEG. IMPACT ON CLOSURE EDGE. STITCHING BREAKAGE | SEPARATE SIDE TAB |
| 18 | 1410 | FAIR: YES PENET: PARTIAL | 30 DEG. IMPACT ON CLOSURE EDGE, CLOSURE HELD SECURE | SEPARATE SIDE TAB |
| 19 | 1444 | FAIR: YES PENET: PARTIAL | 30 DEG. ON CLOSURE EDGE. HOOK BACKING TORE APART | SEPARATE SIDE TAB |
| 20 | 1407 | FAIR: YES PENET: PARTIAL | VELCRO CLOSURES HELD SECURE ON IMPACT | ELASTIC |
| 21 | 1389 | FAIR: YES PENET: PARTIAL | 30 DEG. OBLIG. CLOSURES HELD SECURE ON IMPACT | ELASTIC |
| 22 | 1400 | FAIR: YES PENET: PARTIAL | 30 DEG. OBLIG. CLOSURES HELD SECURE ON IMPACT | ELASTIC |

Figure 8:
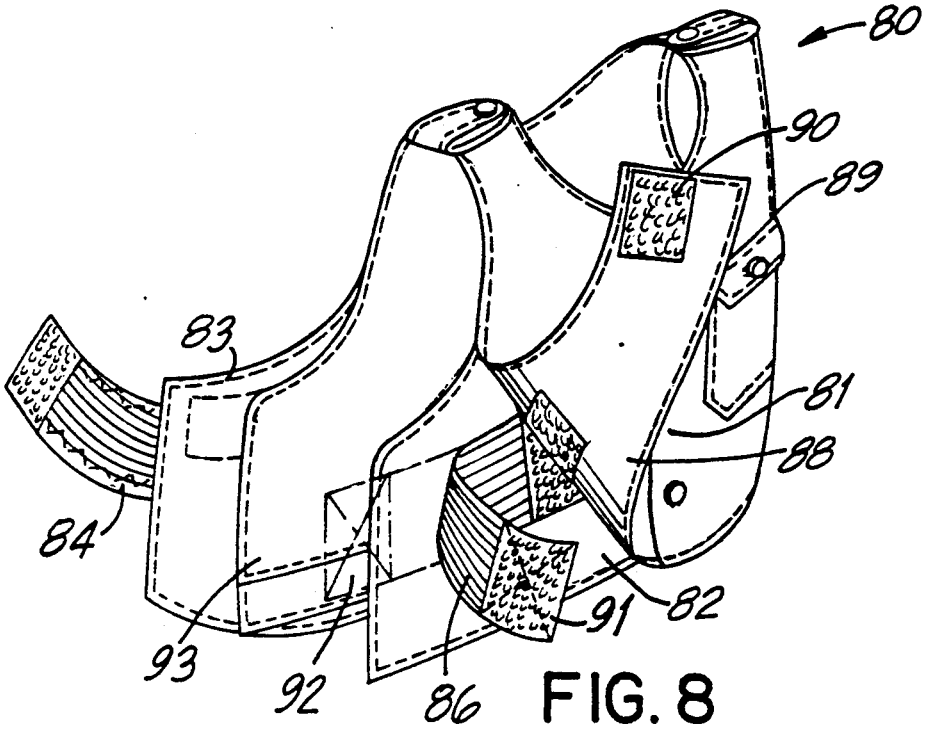
FIG. 8 shows an alternative embodiment of the protective body armor garment shell of the invention.

Another embodiment of the present invention is shown in FIG. 8. A garment shell 80 has an outer facade 81 which is a layer simulating a uniform garment. This facade covers a carrier garment 82 disposed beneath the facade and connected along the shoulder, chest and upper back portions to the facade. A back panel 83 of the facade has straps 84 and 85 which provide the draping feature of the garment as previously described. However, a second pair of straps 86 and 87 extend from an outer surface 88 of the front carrier portion 89. These allow the front carrier alone to be secured to the back panel 83 while the front facade drapes over the chest. The facade additionally has a pair of separable fasteners 90 which attach to the strap end outer surfaces 91 and/or side fasteners of the back panel.

Figure 9:
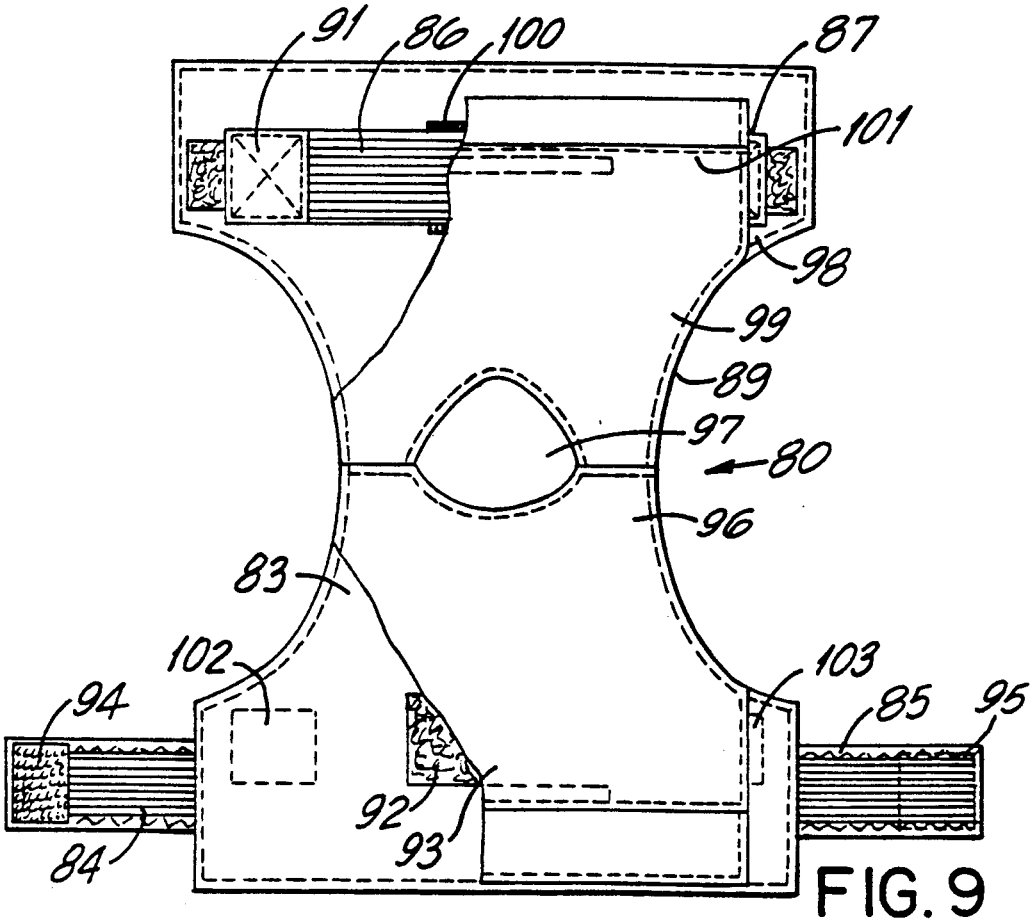
FIG. 9 is a view of the inner surfaces of the garment shell of FIG. 8.

Referring to FIG. 9, the garment shell 80 has a facade back panel and a carrier back panel connected by a separable fastener 92. The carrier has a pocket 93 for containing a body armor panel therein. The straps 84 and 85 have fasteners 94 and 95 at the ends thereof for attachment over the waist. A pair of shoulder portions 96 connect the front and back panels together and define an opening 97 for the head.

The garment shell also has a facade front panel 98 and a carrier front panel 99 connected by a separable fastener 100. The carrier has a pocket 101 for containing a body armor panel therein. The straps 86 and 87 extend from the center of the carrier front panel and have fasteners on both sides of the outer edges thereof for attachment to side fasteners 102 and 103. The fasteners 90 attach the front facade to the back panel fasteners 102 and 103, though they may also engage the strap ends 91.

This embodiment offers more alternatives for balancing comfort and safety, allowing the facade alone, or the facade and front carrier to drape. Table III shows ballistic impact test which establish that the carrier and facade remain secure.

TABLE III

| TEST | VELOCITY, FPS | HIT/PENETRATION | COMMENTS |
|---|---|---|---|
| 1 | 1458 | FAIR: YES PENET: PARTIAL | 30 DEGREE OBLIQ. CLOSURES, HELD SECURE |
| 2 | 1454 | FAIR: YES PENET: PARTIAL | 30 DEGREE OBLIQ. CLOSURES HELD SECURE |
| 3 | 1450 | FAIR: YES PENET: PARTIAL | 30 DEGREE OBLIQ. CLOSURES HELD SECURE |
| 4 | 1448 | FAIR: YES PENET: PARTIAL | 30 DEGREE OBLIQ. CLOSURES HELD SECURE |
| 5 | 1427 | FAIR: YES PENET: PARTIAL | CLOSURES HELD SECURE |

Utilizing a lightweight garment which simulates a uniform shirt for holding protective body armor panels increases the ease with which body armor can be donned or doffed. In addition, protection is maximized as the protective body armor panels are still concealed from view. Since the officer's comfort is maximized, the utilization of protective body armor shall be greatly increased. Also, since body armor is known to be particularly uncomfortable in hot weather, the ability to loosen the front panel and allow ventilation should significantly increase comfort and again enhance utilization.

While preferred embodiments of the present invention have been shown and described it will be understood by those skilled in the art that various changes and modifications could be made without varying from the scope of the present invention. For example while a particular simulated official garment has been disclosed, it will be understood by those skilled in the art that various other simulated garment features could be provided in place of those shown and still be within the scope of the present invention.

We claim:

1. A protective body armor garment shell comprising a front portion, a back portion, and means for interconnecting said portions over a person's shoulders, and, belt means extending from the back or front portion for securing the back or front portion to the person's body, the belt means being engaged to secure either one of the back or front portion to the body, beneath the other of the back or front non-secured portion, allowing the non-secured portion to drape over the body, and carrier means for locating protective body armor panels beneath the garment shell, the carrier means being partially integral with the garment shell front and rear portions, and being drapable therewith, protective body armor panels located within the carrier means; and, attachment means for attaching the front portion releasably to the back portion at the person's sides.

2. The garment shell of claim 1 wherein the belt means extend from the back portion.

3. The garment shell of claim 1 wherein the belt means comprise a pair of straps having means for engaging to secure the garment shell to the person's body.

4. The garment shell of claim 1 wherein the carrier garment means has a front portion comprising a front layer and a back layer between which a pocket is formed.

5. The garment shell of claim 4 wherein the carrier means has a back portion comprising a front layer and a back layer between which a pocket is formed.

6. The garment shell of claim 1 wherein the garment shell has the appearance of a uniform garment.

7. The garment shell of claim 6 wherein the front portion has buttons, epaulets and pockets to simulate a uniform garment appearance.

8. The garment shell of claim 1 wherein the attachment means are opposed fasteners which are disposable in a facing relationship on the front and back portions after placing the garment shell on the person's body.

9. The garment shell of claim 4 wherein the front layer has two overlaid sections which form an opening therebetween, the body panel being insertable or removable through said opening into said pocket.

10. The garment shell of claim 5 wherein the back layer has two overlaid sections which form an opening therebetween, the body panel being inserted or removed through the opening into the pocket.

11. A protective body armor garment shell comprising a front portion, a back portion, each portion including pocket means, body armor panels disposed within the pocket means, means for interconnecting side portions over a person's shoulders, belt means extending from the back or front portion for securing the back or front portion to the person's body, the belt means being engaged to secure either one of the back or front portion to the body, beneath the other of the front or back non-secured portion, allowing the non-secured portion to drape over the body, side separable fasteners provided on opposing lower portions of the front and back portions, the front portion side fasteners attached at least along an inner edge of the fastener to the front portion.

12. The body armor garment shell of claim 11 wherein each front portion side fastener is attached along both the inner and an outer edge thereof to the front panel.

13. The body armor garment shell of claim 11 further comprising an elastic strip disposed between the inner edge of each front portion side fastener and an outer edge of the front panel.

14. The body armor garment shell of claim 11 further comprising an outer fabric layer extension forming a pleat to conceal the attachment of the inner edge of each front side fastener to the front panel.

15. The body armor garment shell of claim 11 wherein each front portion side fastener is a separate assembly comprising a fabric layer stitched over a hook and pile fastener.

16. The body armor garment shell of claim 11 wherein the inner edge of each front portion side fastener is stitched to the front panel.

17. The body armor garment shell of claim 12 wherein each front portion side fastener is stitched along both the inner and outer edges to the front panel.

18. The protective body armor of claim 11 wherein an adhesive is used to attach each front portion side fastener to the front panel.

* * * * *